United States Patent [19]

Neff

[11] 4,202,540

[45] May 13, 1980

[54] BAR-TYPE CLAMP

[76] Inventor: Lawrence M. Neff, 10031 E. 52nd St., Tulsa, Okla. 74145

[21] Appl. No.: 956,197

[22] Filed: Oct. 30, 1978

[51] Int. Cl.[2] ..... B25B 1/02

[52] U.S. Cl. ..... 269/166; 269/196; 269/236; 269/239

[58] Field of Search ..... 269/236, 239, 169, 166, 269/167, 164, 196

[56] References Cited

U.S. PATENT DOCUMENTS

| | | | |
|---|---|---|---|
| 669,282 | 3/1901 | Lanpher | 269/166 |
| 781,356 | 1/1905 | Peelman | 269/239 |

FOREIGN PATENT DOCUMENTS

| | | | |
|---|---|---|---|
| 156535 | 5/1954 | Australia | 269/196 |

*Primary Examiner*—Robert C. Watson
*Attorney, Agent, or Firm*—Head & Johnson

[57] ABSTRACT

A clamp including an elongated cylindrical bar, a backup member having integral extending arm, the backup member being slidably positioned on the bar, a base member having a body portion with an opening therethrough and an integral arm extending generally parallel the backup arm, an intermediate member pivoted to the base member and extending generally parallel to it, and an actuating member pivotally received at the outer end of the base member arm and pivotal in one direction to urge the intermediate member toward the backup member so that an object positioned between the backup member and intermediate member may be clamped.

9 Claims, 7 Drawing Figures

BAR-TYPE CLAMP

BACKGROUND AND OBJECTS OF THE INVENTION

Manufacturing, machining, woodworking, and many other types of operations frequently require a clamp for grasping opposite ends of an object. The present invention is directed towards a clamp which can apply a grasping force to hold an object. The clamp is particularly adapted for grasping objects of widely varying lengths.

It is therefore an object of this invention to provide an improved clamp.

More particularly, an object of this invention is to provide a clamp in which all the components are supported on an elongated cylindrical bar, such as a length of pipe, and in a way such that the clamp is adjustable to grasp an object wherein the length of the object is limited only by the length of the bar.

Still more particularly, an object of this invention is to provide a bar-type clamp including a backup member and including a base member which can be spaced at variable distances from the backup member, with an intermediate member pivoted to the base member in the direction toward the backup member, the base member having an actuating member so that when an object is positioned between the backup member and the intermediate member, the actuating member may be pivoted to apply force to move the intermediate member towards the backup member to firmly grasp an object therebetween.

These general objects as well as other and more specific objects of the invention will be fulfilled in the following description and claims, taken in conjunction with the attached drawings.

DESCRIPTION OF THE VIEWS

SUMMARY OF THE INVENTION

A clamp is provided in which the components are supported on an elongated cylindrical bar, such as a length of pipe. A backup member having a body portion with an opening therein receives the pipe in the opening. The backup member includes an arm integrally extending from the body and in a plane generally perpendicular to the cylindrical bar. The dimension of the opening in the body of the backup member is slightly greater than that of the bar so that force applied to the outer end of the arm portion causes the body of the backup member to engage the bar in a non-sliding relationship. A base member is provided having a body portion with an opening which slidably receives the bar and in which the opening is dimensioned such that force applied to the integral outwardly extending arm of the base member causes the base member to engage the bar in a non-sliding relationship. The arm of the base member extends generally perpendicular to the bar, and therefore, parallel the arm of the backup member. The fourth element of the clamp is an intermediate member which has a body portion pivotally secured to the base member. The intermediate member has an integral arm which extends generally parallel the base member arm and therefore, generally perpendicular to the bar. The intermediate member is received on the bar between the backup member and the base member. The fifth element of the clamp is an actuating arm which is pivotally received at the outer end of the base member arm. The actuating member has a handle portion at one end and at the other end a cam surface which engages the intermediate member arm. An object is supported by the clamp by placing it between the outer end of the backup member arm and the outer end of the intermediate member with the distance between the backup member and the base member being adjusted so that the object to be grasped is snugly received between the backup member and the intermediate member. Then, the actuating member is pivoted by rotation of the handle portion so that the cam surface forces the intermediate member away from the arm of the base member and in the direction towards the backup member, thereby firmly grasping the object between the intermediate member and the backup member, and, simultaneously, serving to apply force at the outer end of the base member to more securely cause it to non-slidably engage the cylindrical bar.

DETAILED DESCRIPTION

Figure 4:
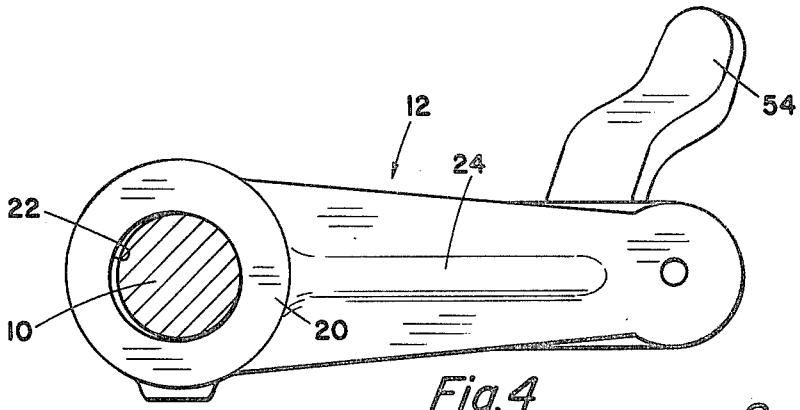
FIG. 4 is a cross-sectional view taken along the line 4—4 of FIG. 1.
Figure 1:
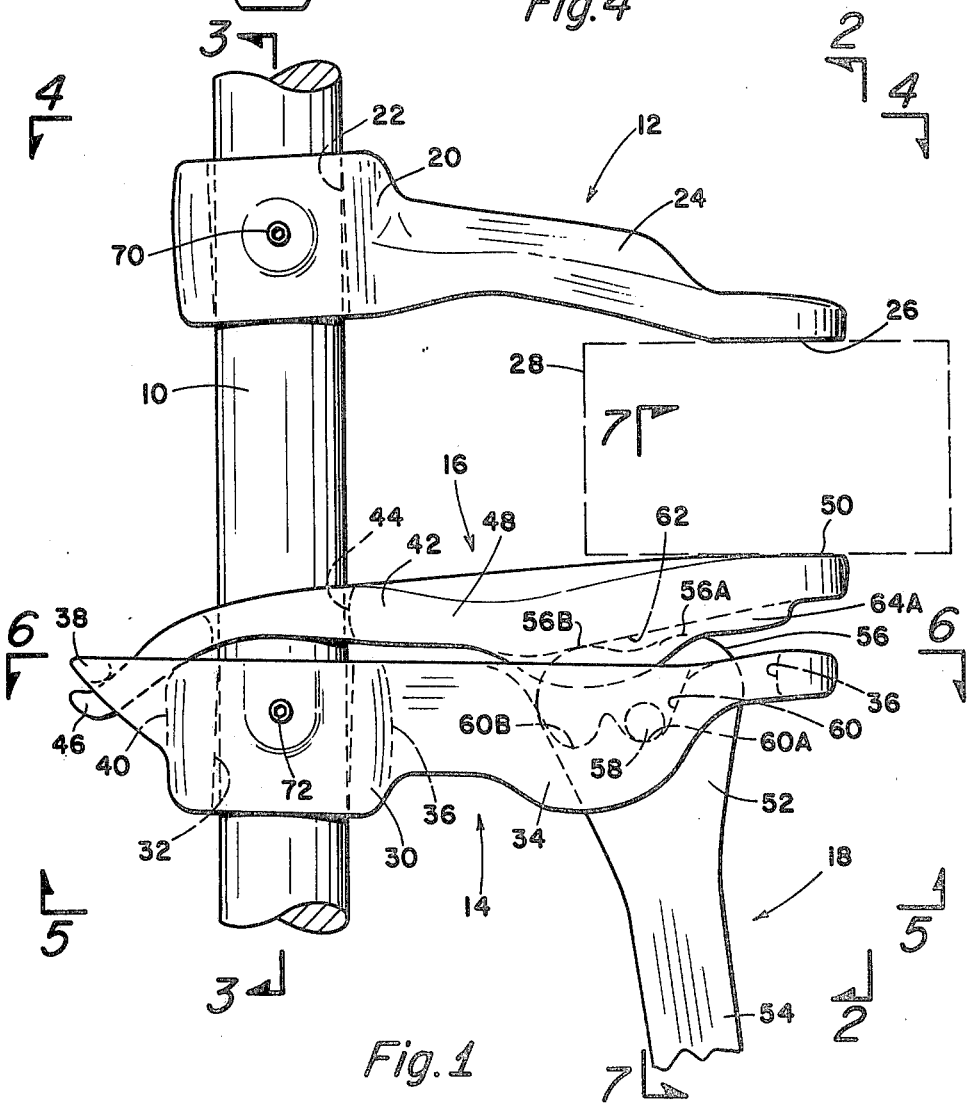
FIG. 1 is an elevational view of the clamp of this invention including the arrangement wherein the bar is supported in a vertical position, and showing an object grasped by the clamp.
Figure 2:
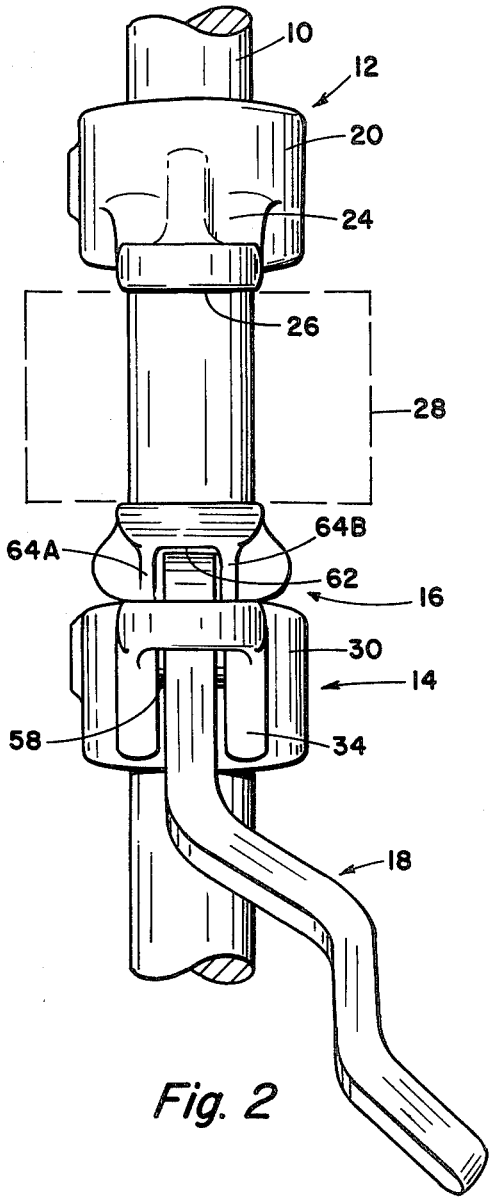
FIG. 2 is an elevational view as shown along the line 2—2 of FIG. 1.

Referring to the drawings, and first to FIGS. 1 and 2, the clamp of this invention is shown in elevational view. The clamp includes five major components, that is, an elongated cylindrical bar 10, a backup member generally indicated by the numeral 12, a base member generally indicated by the numeral 14, and intermediate member generally indicated by the numeral 16, and an actuating member generally indicated by the numeral 18.

Referring first to the backup member 12, it includes a body portion 20 having an opening 22 which slidably receives the cylindrical bar 10. Integrally extending from the body 20 in a plane generally perpendicular to the axis of opening 22 is an arm portion 24. The outer end of the arm portion includes a planar surface 26 which is adaptable to engage an object 28 to be supported by the clamp.

The opening 22 in the backup member 12 is dimensioned such that when no force is applied to the outer end of arm 24, the backup member can be slidably positioned on bar 10, but when force is applied at the outer end of the arm 12, such as at planar surface 26, the backup member is tilted slightly relative to the axis of bar 10, causing the opposed edges of opening 22 to contact the bar 10 with increased frictional engagement, preventing the backup member from moving.

Figure 5:
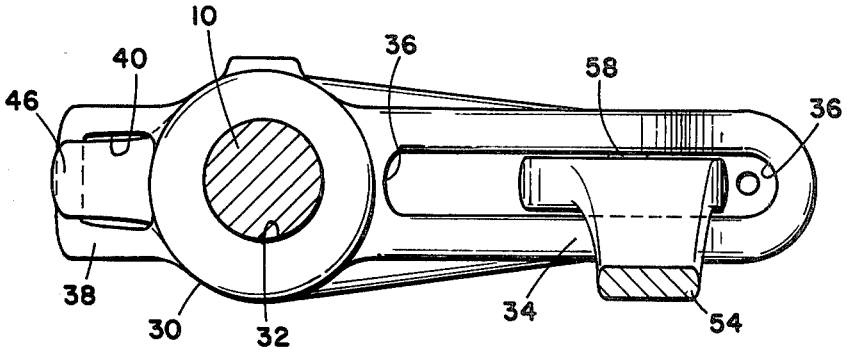
FIG. 5 is a cross-sectional view taken along the line 5—5 of FIG. 1.
Figure 6:
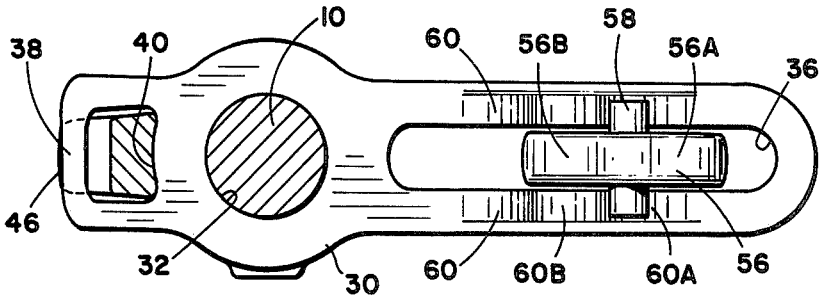
FIG. 6 is a cross-sectional view taken along the line 6—6 of FIG. 1.

The base member 14 has a body portion 30 with an opening 32 therein which slidably receives bar 10. Integrally extending from the base portion 30 is arm 34 which generally extends in a plane perpendicular to the axis of opening 32. As was described with reference to opening 22 in backup member 24, the opening 32 in base member 14 is dimensioned such that when force is applied to the outer end of arm 34 the base member tends to tilt relative to bar 30 so that the opposed edges of opening 32 engage the bar with increased frictional contact, preventing the base member 14 from sliding on the bar. As seen in FIGS. 5 and 6, the base member 14 has a slot 36 in arm 34. The body portion 30 has an integral extending portion 38 which extends in the direction opposite arm 34. Extending portion 38 has a slot 40 therein.

The fourth element of the clamp is the intermediate member 16 having a body portion 42 with an opening 44 therein which loosely receives the cylindrical bar 10. Body portion 42 has an integral tapered hook portion 46 which is received within slot 40 formed in the extending portion 38 of the base member 14. Extending in the direction opposite the hook portion 46 is an integral arm portion 48 which extends generally parallel the base member arm portion 34 and adjacent to it. The intermediate member 16 is positioned between base member 14 and backup member 12. The outer end of the integral arm portion 48 has a planar surface 50 adapted to engage the object 28 supported by the clamp. The surface 50 is opposite surface 26 of backup member 12 with the object 28 clamped between these two surfaces.

Figure 7:
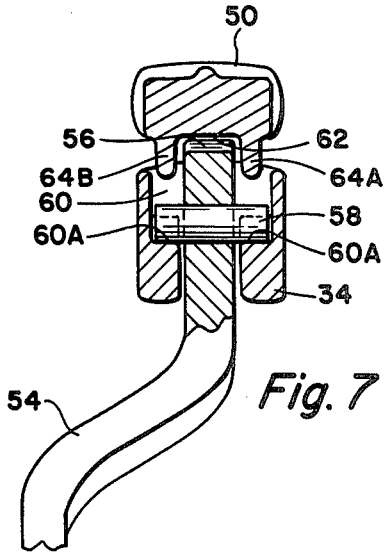
FIG. 7 is a cross-sectional view taken along the line 7—7 of FIG. 1.

The fifth element of the clamp is the actuating member 18 having a body portion 52 which is received in slot 36 in base member 14. Integrally extending from the body portion 52 is handle portion 54. The body portion 52 has a cam surface 56 which is opposite the handle portion 54, the cam surface 56 slidably engaging the arm portion 48 of intermediate member 16 on the side of the arm portion opposite surface 50. A pin 58 is received by the actuating member body portion 52 and is perpendicular to it. As seen in FIGS. 6 and 7, the slot 36 in base 14 is wider on the side of arm 34 adjacent intermediate member 16 providing an internal ledge 60. Pin 58 of the actuating member 18 engages ledge 60 to thereby retain the actuating member 58 within slot 36 of the base member 14. In the illustrated arrangement, the ledge 60 is of a "W" shaped configuration providing a first maximum depth recess 60A in which the pin 58 is resting in FIG. 1, and a second maximum depth recess 60B. This enables the actuating member 58 to be pivotally positioned in either recess 60A or 60B. Since recess 60A is at a further distance from the cylindrical bar 10, greater leverage is applied by cam surface 56 against the intermediate member 16 when the pin 58 is in recess 60A than when it is in recess 60B; however, more movement of handle 54 is required to achieve a corresponding amount of displacement of the intermediate member 16 away from base member 14, whereas when pin 58 is in recess 60B, less movement of handle 14 is required, but greater force is necessary to achieve displacement of intermediate member 16. In addition, with the pin 58 in recess 60B, the total amount of displacement of intermediate member 16 is greater.

The cam surface 56 of actuating member 18 may be of various configurations. In the illustrated arrangement, the cam surface 56 includes a first lobe portion 56A and a second lobe portion 56B. This means that the intermediate member 16 may be moved away from base member 14 by pivotation of handle 54 in either direction. When handle 54 is moved in the direction towards cylindrical bar 10, greater displacement of the intermediate member 16 is obtained, although more handle force is required by the engagement of second lobe 50B with an intermediate member 16 than is required when the handle 54 is moved in the direction away from cylindrical bar 10 when lobe 56A engages the intermediate member. Thus, the operator can move handle 54 in either direction and will move the handle in the direction towards cylindrical bar 10 when greater displacement of intermediate member 16 is required, but will move the handle 54 in the direction away from the cylindrical bar 10 when less displacement but greater applied force is required by the intermediate member 16 against an object 28.

The rear surface of the intermediate member 16 includes a central cam receiving surface 62 (see FIGS. 2 and 7). To either side of the cam receiving surface 62 are integrally extending ridges 64A and 64B which receive the outer end of the body portion 52 of actuating member 18 therebetween. When the intermediate member 16 is moved in its maximum direction towards base member 14, the ridges 64A and 64B are received within the wide portion of slot 36.

OPERATION

When an object 28 is to be engaged by the clamp, either the backup member 12 or the base member 14 (with its attached intermediate members 16 and actuating member 18) may be moved on bar 10 to the position wherein the surfaces 26 and 50 engage the member 28. When initial engagement is achieved, the actuating member 18 is positioned so that the cam surface 56 engages the cam surface 62 of intermediate member 16 in a manner permitting the arm portion 48 of the intermediate member to lie in its closest proximity to the arm portion 34 of base member 14. To clamp the object 28, actuating member handle 54 is rotated in either direction. Rotation causes the cam surface 56, and in the illustrated arrangement, either lobe 56A or lobe 56B, depending upon the direction of rotation of handle 54, to force the intermediate member 16 away from arm 34 of base member 14. This applies increased force of contact of surfaces 26 and 50 with object 28. At the same time, this force is applied to the outer end of the arms 24 of the backup member and arm 34 of the base member to lock them in non-sliding relationship with the cylindrical bar 10. In this manner the object 28 is held in position. The frictional engagement of the cam surface 56 with the backup member cam receiving surface 62 maintains the actuating member 28 in any position in which it is left, as required to apply the desired force on object 28. To release the clamp, all that is necessary is to move the handle 54 back to the central position, allowing the intermediate member 18 to retract toward the arm 34 of base member 14, relieving pressure on object 28 and allowing either the backup member 12 or base member 14 to be slidably positioned on the cylindrical bar 10 away from object 28.

ALTERNATE EMBODIMENT

Figure 3:
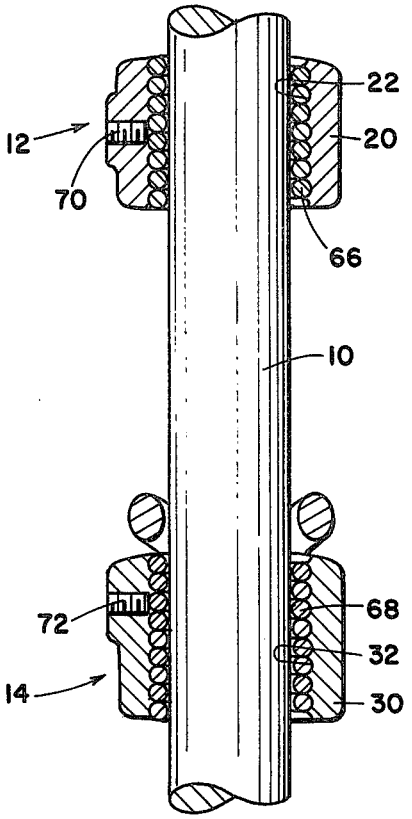
FIG. 3 is a cross-sectional view taken along the line 3—3 of FIG. 1.

The clamp of this invention is preferably manufactured of a moldable material, and an ideal material for manufacturing the clamp is aluminum. When the clamp is manufactured of aluminum, or any other malleable material, there will be a tendency for the edges of openings 22 in backup member 12 and opening 34 in base member 14 to become slightly rounded after repeated use. This rounding of the crtical edges may lessen the tenacity with which the members engage the bar 10 in non-sliding relationship and, of course, this tendency will be greater when a soft material, such as aluminum, is utilized. To take advantage of the use of malleable material for the construction of the clamp, the alternate arrangement of FIG. 3 may be employed. In this arrangement, a steel spring 66 is positioned within the opening 22 in the backup member body portion 20. To utilize spring 66, the opening 22 is made larger than the diameter of cylindrical bar 10 so as to accommodate spring 66, and in the arrangement wherein the internal diameter of the coil spring 66 is slightly greater than the diameter of cylindrical bar 10. This arrangement permits the backup member to be slidably positioned on the bar 10 as previously described but utilizes the characteristics of the steel spring to reduce deformation as it absorbs force when an object is clamped, thereby preventing rounding off the corners of opening 22.

In like manner, a spring 68 is positioned in opening 32 in the body portion 30 of the base member to resist tendency of the base member edges to be distorted by pressure against bar 10. With the arrangement of FIG. 3, the backup member 12, base member 14, intermediate member 16, and actuating member 18 may all be effectively cast out of aluminum to substantially reduce the weight of the clamp and yet provide a clamp having extremely long-lasting characteristics. Further, the use of springs 66 and 68 serve to enhance the gripping effect on the cylindrical bar 10 when force is applied at the outer end of the integral arm portions to grasp an object.

An additional alternate arrangement includes the use of set screws 70 and 72 placed in threaded openings in the body portions 20 and 30 respectively of the backup member and base member. The use of set screws 70 and 72 is limited to circumstances wherein it is desired to maintain either the backup member or the base member, or both, in a preselected position. If desired, the set screw 72 may be threadably advanced to lock the base member in position and allow only the backup member to be moved to accept variable size objects. Where the clamp is to be used repeatedly with objects of the same dimension, then both set screws 70 and 72 may be utilized to hold the members in the required position.

The clamp of this invention provides a device for firmly grasping an object, the length of which is limited only by the length of the cylindrical bar 10. The clamp is very quickly and expeditiously adjusted to any length member and very quickly actuated to grasp the member or to release pressure on the member.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A clamp comprising:

an elongated bar;

a backup member having a body portion with an opening therein receiving said bar, and an arm integrally extending from the body into a plane generally perpendicular to the axis of the opening in the body portion, the dimension of the opening being such that force exerted adjacent the outer end of the arm portion engages the body portion with said bar in non-sliding relationship;

a base member having a body portion with an opening therein slidably receiving said bar, and having an arm portion integrally extending from the body in a plane generally perpendicular to the axis of the opening in the body portion, the dimension of the opening being such that force exerted adjacent the outer end of the arm portion engages the body portion with said bar in non-sliding relationship, an integral extension portion extending from the body portion in the direction opposite the arm portion;

an intermediate member having a body portion having an opening therein receiving said bar and an integral arm portion extending generally parallel said base portion arm and displaceable relative to said base member arm portion in the direction towards said backup member, the body portion having an integral extension portion extending in the direction opposite the arm portion;

means of pivotally interconnecting said base member extension portion with said intermediate member extension portion; and an actuating member pivotally received at the outer end of said base member arm, the actuating member having a body portion and a handle portion integrally extending therefrom, the body portion having a cam surface engaging said intermediate member arm, whereby an object to be clamped may be positioned between said backup member arm portion and said intermediate member arm portion, and the handle of the actuating member pivoted to cause the cam surface to push said intermediate member away from said base member arm portion to forcibly engage an object positioned between said backup member arm and said intermediate member.

2. A clamp according to claim 1 wherein said base member extension portion has an opening therein and wherein said intermediate member hook portion is defined by a reduced dimensioned outer end which is loosely received in the base extension portion opening forming said means of pivotally interconnecting said intermediate member with said base member.

3. A clamp according to claim 1 in which said backup member arm portion has a flat object engaging surface at the outer end thereof and said intermediate member arm portion also has a flat object engaging surface at the outer end thereof, the surfaces facing each other and being generally parallel with each other.

4. A clamp according to claim 1 wherein said base member arm portion has an opening therein in the plane of said bar, and wherein said actuating member is pivotally received in said opening.

5. A clamp according to claim 4 wherein said base member arm portion has a recess therein in the side of the arm portion facing said intermediate member, said opening in the arm portion communicating with the recess, and wherein said actuating member includes pivot posts extending about a common axis from opposite sides of said body portion, said pivot posts being pivotally received in said base member recess.

6. A clamp according to claim 5 wherein said recess in said base member arm portion has a plurality of notches therein at varying distances from said base member body portion and wherein said actuating member pivot posts may be positioned in selectable notches to thereby vary the point of contact of said actuating member cam surface with said intermediate member arm.

7. A clamp according to claim 1 including:

a coiled spring positioned within said opening in said body portion of said backup member; and a coiled spring positioned within said opening in said body portion of said base member, the internal diameter of the springs being slightly greater than the external diameter of said bar whereby the backup and base members may be slidably positioned on said bar and whereby force applied to the outer ends of the arm portions of the backup and base members cause the springs to engage the bar in non-sliding relationship.

8. A clamp according to claim 1 wherein said body portions of said backup and base members each have a small diameter threaded opening therein, the axii of which are perpendicular the bar axis, and including:

a set screw positioned in each said threaded opening, the inner end of which engages said spring in said backup and base member body openings whereby when the set screws are threaded inward said springs are forced against said bar to non-slidably lock said backup member and said base member to said bar.

9. A clamp comprising:

an elongated cylindrical bar;

a backup member having a body portion with an opening therein receiving said bar, and an arm integrally extending from the body into a plane generally perpendicular to the axis of the opening in the body portion;

a coiled spring positioned within said opening in said body portion of said backup member;

a base member having a body portion with an opening therein slidably receiving said bar, and having an arm portion integrally extending from the body in a plane generally perpendicular to the axis of the opening in the body portion;

a coiled spring positioned within said opening in said body portion of said base member, the internal diameter of the spring being slightly greater than the external diameter of said bar whereby the backup and base members may be slidably positioned on said bar and whereby force applied to the outer ends of the arm portions of the backup and base members cause the springs to engage the bar in non-sliding relationship;

an intermediate member having a body portion pivotally secured to said base portion and an integral arm portion extending generally parallel said base portion arm and displaceable relative to said base member arm portion in the direction towards said backup member; and an actuating member pivotally received at the outer end of said base member arm, the actuating member having a body portion and a handle portion integrally extending therefrom, the body portion having a cam surface engaging said intermediate member arm, whereby an object to be clamped may be positioned between said backup member arm portion and said intermediate member arm portion, and the handle of the actuating member pivoted to cause the cam surface to push said intermediate member away from said base member arm portion to forcibly engage an object positioned between said backup member arm and said intermediate member.

* * * * *